US005803282A

United States Patent [19]

Chen et al.

[11] Patent Number: 5,803,282

[45] Date of Patent: Sep. 8, 1998

[54] VACUUM INDICATOR FOR A BOTTLE

[76] Inventors: Pao Ting Chen, No. 77, Wen Ah, Wen Ah Tsuen, Dong Shr Hsiang, Chia Yi Hsien; Hsin Yu Chen, No. 53, Hsin Yi St., Ben Hsiang Tsuen, Wu Fong Hsiang, Taichung Hsien; Cai Lian Liu, 3F., No. 34, Lane 37, Sec. 1, Da Ching St., Taichung, all of Taiwan

[21] Appl. No.: 768,774

[22] Filed: Dec. 13, 1996

[51] Int. Cl.[6] ..... B65D 51/24

[52] U.S. Cl. ..... 215/228; 215/230; 220/212; 220/DIG. 16; 116/272; 116/324

[58] Field of Search ..... 215/230, 228, 215/270; 220/254, 212, DIG. 16, 89.1, 203.27, 231; 206/459.1, 459.5, 524.8, 315.9, 534; 116/309, 311, 312, 315, 316, 268, 270, 272, 281, 324, 321, 318, 308

[56] References Cited

U.S. PATENT DOCUMENTS

| | | | |
|---|---|---|---|
| 3,203,391 | 8/1965 | Corwin | 116/308 |
| 3,492,968 | 2/1970 | Workman, Jr. | 116/270 |
| 3,780,693 | 12/1973 | Parr | 116/270 |
| 3,872,823 | 3/1975 | Durdin | 116/318 X |
| 4,019,629 | 4/1977 | Dubner et al. | 206/315.9 |
| 4,178,932 | 12/1979 | Ryder et al. | 116/272 X |
| 4,249,583 | 2/1981 | Lundbladh | 116/268 X |
| 4,706,830 | 11/1987 | Wareing | 116/270 X |
| 5,558,243 | 9/1996 | Chu | 220/212 |
| 5,564,581 | 10/1996 | Lin | 215/228 |

*Primary Examiner*—Stephen Cronin
*Assistant Examiner*—Nathan Newhouse
*Attorney, Agent, or Firm*—Bacon & Thomas

[57] ABSTRACT

A bottle includes a cap secured on top and having a pipe extended upward and communicating with the interior of the bottle. A pump device is disposed on the cap for vacuuming the bottle. A bellows member is engaged on the pipe and includes a lower end secured to the cap and an enclosed upper end. A cover is engaged on the cap and includes an aperture for allowing the enclosed upper end of the bellows member to move upward beyond the cover. The enclosed upper end of the bellows member may be moved downward for indicating a vacuum status of the bottle when the bottle is vacuumed by the pump device.

4 Claims, 3 Drawing Sheets

VACUUM INDICATOR FOR A BOTTLE

BACKGROUND OF THE INVENTION

1. Field of the Invention

The present invention relates to an indicator, and more particularly to an indicator for indicating the vacuum status of a bottle or a container.

2. Description of the Prior Art

Typical bottles may be used for storing food and other objects. In order to prevent the food from being spoiled, a vacuum pump is provided on the bottle for drawing the air out of the bottle. However, the user may not know whether the bottle has been vacuumed or not.

The present invention has arisen to mitigate and/or obviate the afore-described disadvantages of the conventional bottles.

SUMMARY OF THE INVENTION

The primary objective of the present invention is to provide an indicator for a bottle for indicating the vacuum status of the bottle.

The other objective of the present invention is to provide an indicator for indicating the date and the time of the food stored in the bottle.

In accordance with one aspect of the invention, there is provided a bottle comprising a body an interior and including an upper end, a cap secured on the upper end of the body, the cap including a pipe extended upward and communicating with the interior of the body, means for vacuuming the body, a bellows member engaged on the pipe, the bellows member including a lower end secured to the cap and including an enclosed upper end, and means for biasing the enclosed upper end of the bellows member upward, the enclosed upper end of the bellows member being caused to move downward against the biasing means for indicating a vacuum status of the body when the body is vacuumed by the vacuuming means.

A cover is engaged on the cap and includes an aperture for engaging with the enclosed upper end of the bellows member and for allowing the enclosed upper end of the bellows member to move upward beyond the cover.

A lid is engaged on the enclosed upper end of the bellows member, the lid includes an annular flange for engaging with the cover for preventing the bellows member from being disengaged from the cover.

The cover includes a ring secured on the top thereof. The ring a scale provided thereon and includes a peripheral portion, and the cover includes two slides engaged on the peripheral portion for aligning with the scale and for indicating a time.

The ring includes two stops secured thereon for separating the slides from each other.

Further objectives and advantages of the present invention will become apparent from a careful reading of a detailed description provided hereinbelow, with appropriate reference to the accompanying drawings.

DETAILED DESCRIPTION OF THE PREFERRED EMBODIMENT

Figure 1:
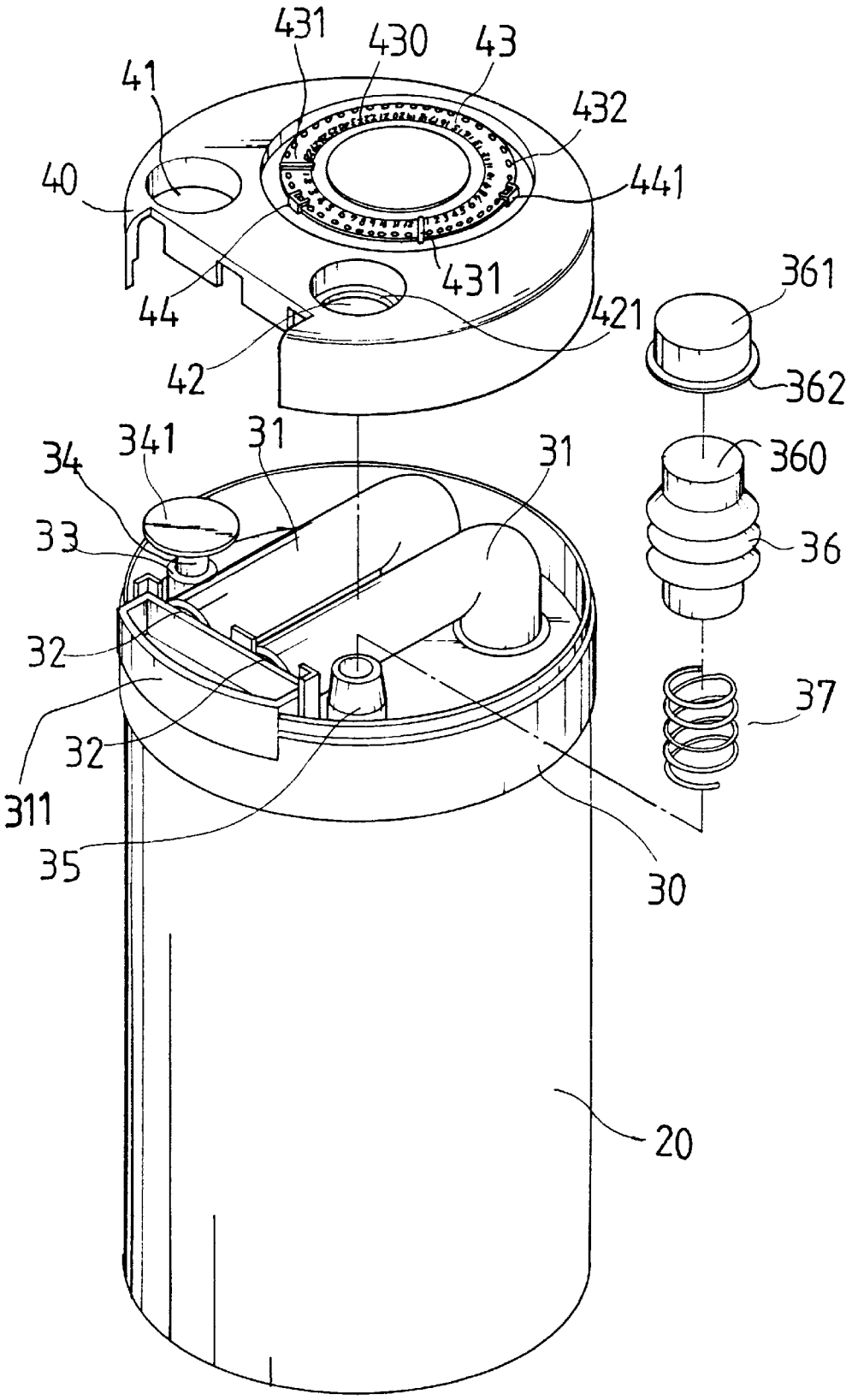
FIG. 1 is an exploded view of a vacuum indicator in accordance with the present invention.
Figure 2:
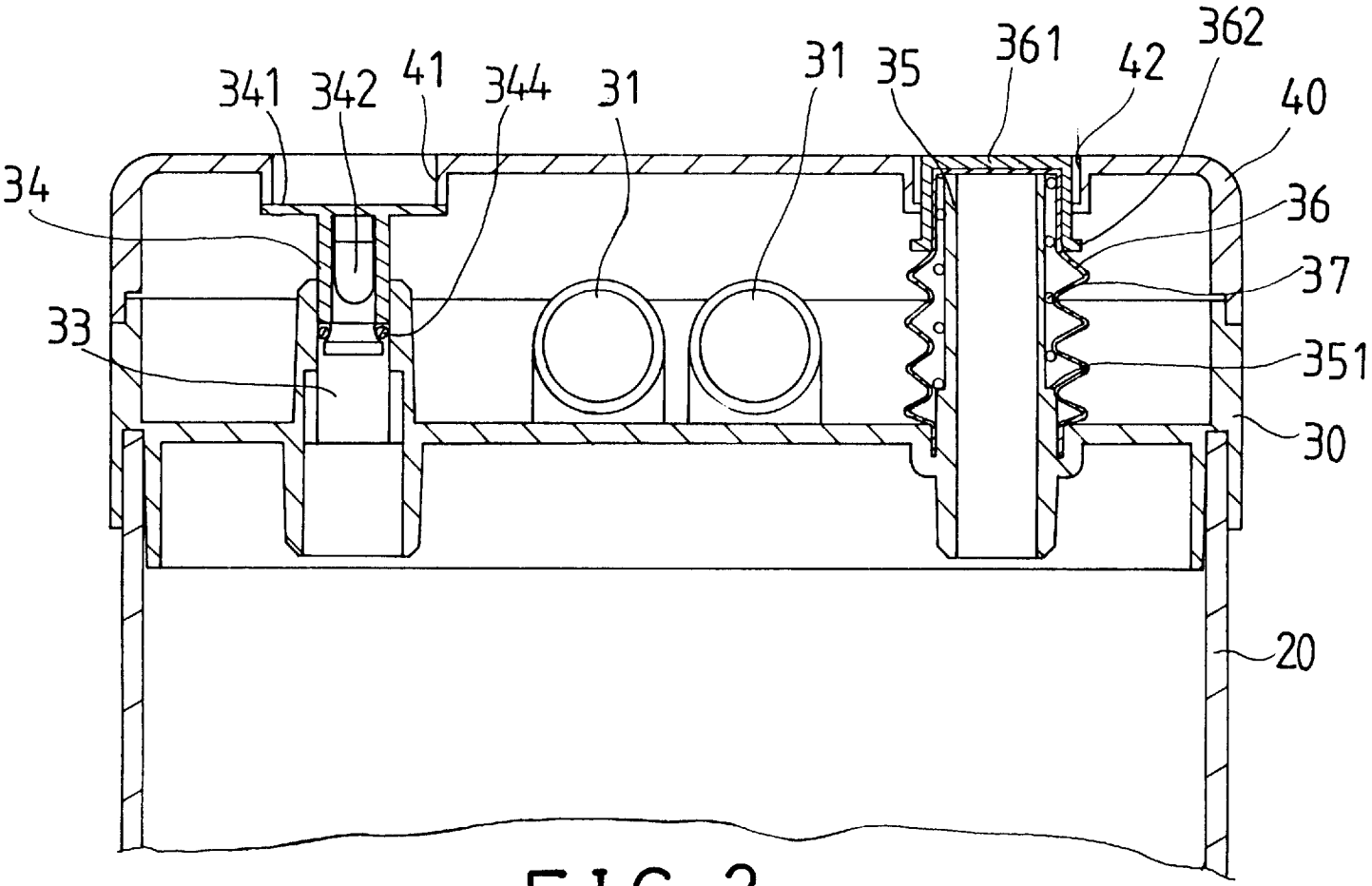
FIGS. 2 and 3 are cross sectional views illustrating the operation of the vacuum indicator.
Figure 3:
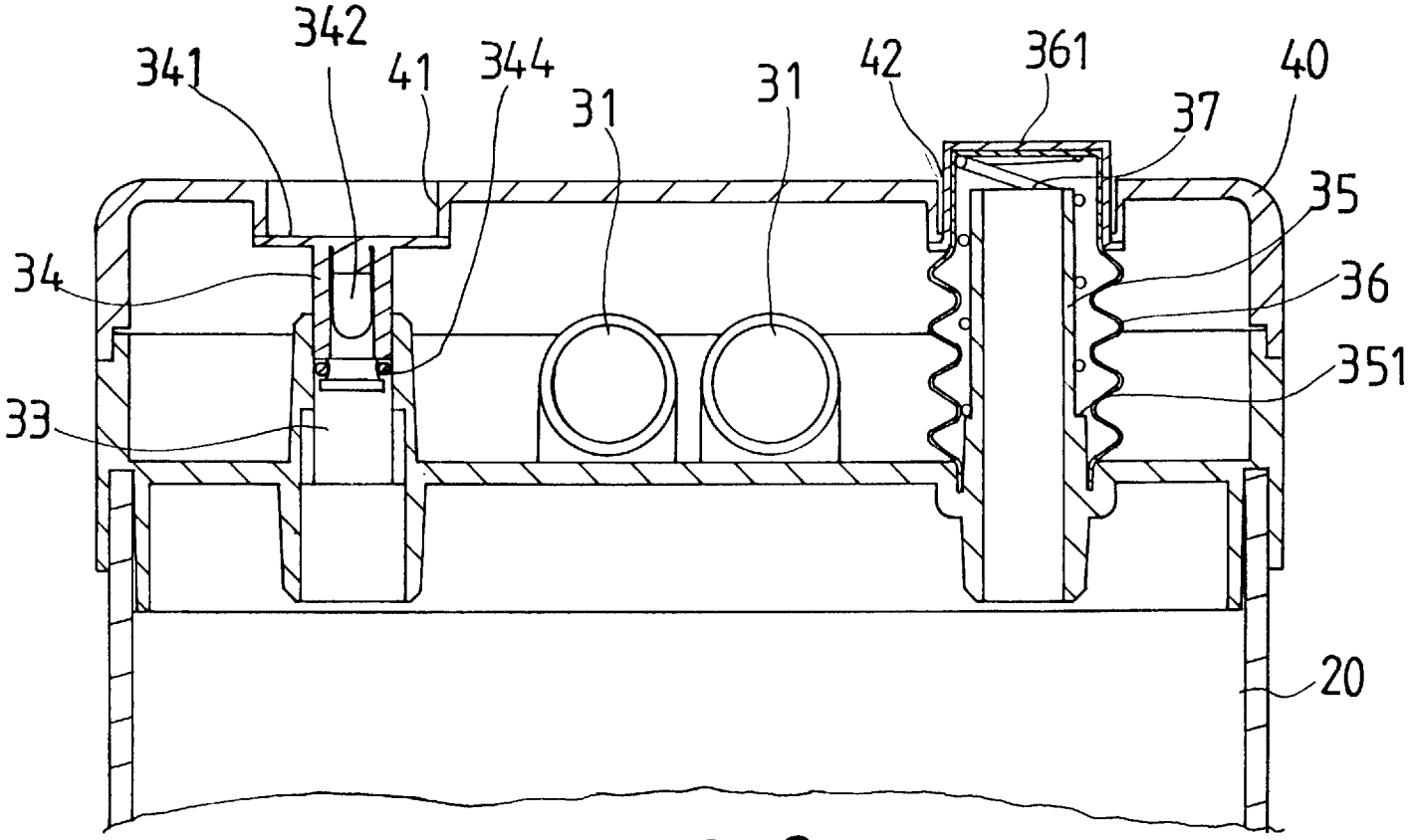

Referring to the drawings, and initially to FIGS. 1 and 2, a bottle in accordance with the present invention comprises a body 20 including a cap 30 engaged on top thereof and a cover 40 engaged on top of the cap 30. The cap 30 includes two tubes 31, each having one end communicating with the interior of the body 20 and each having a pump device 32 slidably engaged in the other end thereof. A knob 311 is secured to the pump device 32 for moving the pump device 32 inward and outward of the tubes 31 and for drawing the air in the body 20 outward of the body 20 and for vacuuming the body 20. The pump device 32 is conventional and commercially available and will not be described in further details. The cap 30 includes a hub 33 having a valve 34 slidably engaged therein. The valve 34 includes a head 341 provided on top and includes an opening 342 for allowing air to flow into the body 20 and includes a sealing ring 344 for making an air tight seal between the valve 34 and the hub 33. As shown in FIGS. 2 and 3, the valve 34 is shown in a top position and the sealing ring 34 prevents exterior air from entering into the body 20. However, when the valve 34 is depressed inward of the hub 33, the opening 342 allows exterior air to flow into the body 20. The cover 40 includes an orifice 41 for engaging with the head 341 and for allowing the head 341 to be depressed inward of the hub 33.

The cap 30 includes a pipe 35 extending upward and communicating with the interior of the body 20. A spring 37 is sleeved on the pipe 35 and engaged with an annular shoulder 351 of the pipe 35 (FIGS. 2 and 3). A bellows member 36 is also sleeved on the pipe 35 and includes a lower end secured to the cap 30 and an enclosed upper end 360. A lid 361 is engaged on the enclosed upper end 360 of the bellows member 36 and includes an annular flange 362 extending radially outward from the bottom portion. The cover 40 includes an aperture 42 for slidably engaging with the lid 361 and an annular flange 421 for engaging with the annular flange 362 and preventing the lid 361 and the upper end 360 of the bellows member 36 from moving upward beyond the cover 40. The spring 37 has an upper end engaged with the enclosed upper end 360 of the bellows member 36 for biasing the lid 361 upward through the aperture 42 (FIG. 3).

The cover 40 includes a ring 43 secured on its top and having a scale 430 or a series of numbers for indicating the month and the date. The ring 43 includes a peripheral portion having two slides 44, 441 engaged thereon which may be moved along the peripheral portion of the ring 43 and aligned with the numerals 430 for indicating the date that the food is stored in the bottle such that the user may be aware whether or not the storing period of the food has expired. The ring 43 includes two stops 431 for separating the two slides 44, 441 and includes a number of projections 432 for engaging with and positioning the slides 44, 441.

In operation, as shown in FIG. 3, when air is contained in the body 20, the spring 37 may bias the lid 361 upward beyond the cover 40 such that the user may be aware that air is in the body 20 and the body 20 has not be vacuumed. When the pump device 32 is used for pumping and vacuuming the body 20, the pressure in the body 20 will be decreased and the enclosed upper end 360 of the bellows member 36 and the lid 361 will be caused to move inward of the cover 40, as best shown in FIG. 2, such that the user may be aware that the body 20 has been vacuumed.

Accordingly, the bottle in accordance with the present invention includes an indicator for indicating the vacuum status of the bottle and includes another indicator for indicating the storing date of the food so as to prevent the food from being stored too long.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bottle comprising:

a) a body including a hollow interior and an upper end;

b) means for producing a vacuum within the interior of the body;

c) a cap secured on the upper end of the body, the cap including a pipe extending upwardly therefrom and communicating with the interior of the body;

d) a bellows member sleeved on the pipe, the bellows member including a lower end secured to the cap and an enclosed upper end;

e) a cover engaged on the cap, the cover including an aperture for slidable engagement with the enclosed upper end of the bellows member and permitting the enclosed upper end to extend upwardly beyond the cover to indicate the absence of a vacuum within the interior of the body; and f) means for biasing the enclosed upper end of the bellows member upwardly and permitting the enclosed upward end to extend downwardly against the biasing means to indicate the presence of a vacuum within the interior of the body.

2. The bottle of claim 1, further including a lid engaged on the enclosed upper end of the bellows member, the lid including an annular flange for engaging the cover and preventing the bellows member from being disengaged from the cover.

3. The bottle of claim 1, wherein the cover further includes a ring secured on a top thereof, the ring including an indicating scale thereon and a peripheral portion, and the cover including two slides engaged on the peripheral portion for alignment with the scale to indicate a time.

4. The bottle of claim 3, wherein the ring further includes two stops secured thereon for separating the slides from each other.

* * * * *